US006536091B1

(12) United States Patent
Brown et al.

(10) Patent No.: US 6,536,091 B1
(45) Date of Patent: Mar. 25, 2003

(54) TRACK LOADING/UNLOADING DEVICE

(75) Inventors: Lewis Kenneth Brown, Christchurch (NZ); Peter Thomas McClay, Christchurch (NZ)

(73) Assignee: Tetral Industries Limited (NZ)

( * ) Notice: Subject to any disclaimer, the term of this patent is extended or adjusted under 35 U.S.C. 154(b) by 0 days.

(21) Appl. No.: 09/632,913

(22) Filed: Aug. 4, 2000

(30) Foreign Application Priority Data

Aug. 6, 1999 (NZ) ..... 337116

(51) Int. Cl.[7] ..... B23Q 3/00; B23P 9/00

(52) U.S. Cl. ..... 29/468; 29/464; 29/450; 160/330; 160/196.1

(58) Field of Search ..... 29/464, 466, 467, 29/468, 450, 453; 160/330, 195, 196.1, 345

(56) References Cited

U.S. PATENT DOCUMENTS 4,706,359 A * 11/1987 Greenhill et al. ..... 29/464
5,309,973 A * 5/1994 Huang ..... 160/345
5,509,713 A * 4/1996 Hou ..... 160/330
5,791,394 A * 8/1998 Huang ..... 160/345
6,050,322 A * 4/2000 Finkelstein et al. ..... 160/330
6,085,826 A * 7/2000 Maesaki ..... 160/345

* cited by examiner

*Primary Examiner*—Gregory M. Vidovich
*Assistant Examiner*—Marc Jimenez
(74) *Attorney, Agent, or Firm*—Gerald E. Hespos; Anthony J. Casella

(57) ABSTRACT

A loading/unloading device for track-mounted attachment elements. The device includes a receiving member adapted to be disposed in a track having a channel which supports a plurality of attachment elements. The receiving member has securing means with a first and a second position, a biasing means biases the securing means in the first position. A loading/unloading member, with a channel, has engagement slots adapted to removably engage with the securing means. The loading/unloading member can be engaged, or disengaged, from the receiving member by a single operator movement. When engaged, attachment elements can be moved between the track channel and the loading/unloading member channel.

13 Claims, 3 Drawing Sheets

TRACK LOADING/UNLOADING DEVICE

FIELD OF THE INVENTION

The present invention relates to methods and apparatus for loading and unloading curtains or other suspended objects from curtain or support railing. More particularly, although not exclusively, the present invention relates to improved methods and devices for loading curtains on and off curtain railing by means of a cartridge mechanism which allows the removal of an entire hanging curtain installation from a particular curtain track. Of course while the present invention is described in the context of curtain installations, it is possible that the invention may find application in other contexts where a plurality of track-located attachment elements need to be installed or removed.

BACKGROUND TO THE INVENTION

The present invention will be described in the context of the installation/removal of curtains wherein the curtains are suspended by a plurality of curtain attachment elements. However, as noted above, the particular features of the present invention may find application in analogous situations where a multiplicity of track-mounted elements needs to be installed or uninstalled. The following description will concentrate primarily on curtain installations.

Prior art curtain installations generally comprise a curtain track, a multiplicity of curtain attachment elements "threaded" on to the track (usually via a channel) and the curtain attached by means of regularly spaced curtain suspension elements attached thereto. It is well known to make and install a curtain by preparing the curtain fabric and affixing along an upper edge thereof a multiplicity of attachment elements—usually hooks, eyelets or other devices—which are adapted to be threaded onto a linear track. Other types of attachment elements may include hooks and eyelets where the eyelets are themselves adapted to be threaded on to the track. The hook/eyelet constructions allow each of the hooks to be detached from a corresponding eyelet and the curtain removed. Alternatively, the curtain can be removed by removing an end cap or other locking device which "seals" the curtain track channel and simply unthreading the multiplicity of attachment elements from the end of the track. Reinstallation of such elements generally involves inserting sequentially the attachment elements into the track or hooking the curtain into the intermediate eyelet or attachment elements sequentially.

Such prior art installation/removal techniques are extremely time consuming as a typical curtain installation may incorporate up to eighty or more attachment elements. The time and effort involved in removal/installation of a curtain is particularly highlighted in the context of, for example, curtain surrounds for hospital beds. These curtains are used for screening and privacy purposes and, given the hygiene requirements of hospitals, need to be regularly removed and cleaned. The removal of such installations can be problematic and highly time consuming as the curtain track is generally suspended high above the floor level thus requiring maintenance staff to have access to an elevated position. Once elevated, the attachment elements are sequentially unhooked or disengaged or the entire curtain is unthreaded from its track. Not only is such a technique extremely time consuming, it may also raise issues of occupational health and safety in a sense that manipulating curtains while elevated poses the risk of falling and injury. Therefore, there may be issues of statutory compliance.

Efforts have been made to overcome the above problems by providing a cartridge loading system which allows a curtain, or other tracked article, to be "loaded" on to a track in a single, simple step. However, cartridge loading systems also suffered the disadvantage that positioning or locking the cartridge in place could be difficult, time consuming and intricate.

A further difficulty arises where more than one curtain is loaded on to the main track. For example if the main track contains three curtains and the curtain most distant from the cassette needs to be removed, all intermediary curtains must be removed so that the required curtain can be positioned on the cassette for unloading.

The present invention attempts to overcome the above-mentioned problems by providing a cartridge loading system for a curtain, or other tracked article, which may be positioned at any point in the track system, thereby allowing a plurality of curtains, or other tracked articles, to be loaded or unloaded independently. Further, the current invention attempts to overcome the problem of having a break in the track channel thereby allowing the curtain, or other tracked article, attachment elements to pass the position of the cassette.

It is also an object of the present invention to provide a loading/unloading system for tracked articles which Is fast and simple to use, overcomes or a least ameliorates a number of the disadvantages inherent in the prior art, or at least to provide the public with a useful choice.

DISCLOSURE OF THE INVENTION

In a first aspect of the invention there is provided a device for loading or unloading a plurality of attachment elements to/from a channel of a track, including:

- a receiving member adapted to be disposed in a track having a channel adapted to receive a plurality of attachment elements, the receiving member having at least one securing means with a first and a second position, a biasing means biasing the securing means in the first position; and
- a loading/unloading member with a channel adapted to receive a plurality of attachment elements, the loading/unloading member having one or more engagement slots adapted to removably engage with the securing means, and wherein the loading/unloading member may be engaged, or disengaged, from the receiving member by a single operator movement, and when engaged the attachment elements can be moved between the track channel and the loading/unloading member channel.

In a second aspect of the invention there is provided a method of loading or unloading a plurality of attachment elements to a channel of a track, the method including the steps of:

- modifying a track to co-operate with a loading/unloading member having a channel adapted to receive a plurality of attachment elements;
- providing, in association with the track, at least one securing means movable between a first and a second position, a biasing means biasing the securing means in the first position;
- engaging, or disengaging, the loading/unloading member to/from the modified track via the securing means; and
- moving a plurality of attachment elements between the track and the loading/unloading member or vice versa to load or unload the attachment elements.

Preferably the securing means is an elongated pin extending, in a substantially horizontal orientation, laterally through the track, or receiving member, with the ends of the pin protruding from either side of the track; the pin being located in, and free to move within, a slot orientated longitudinally with the track, or receiving member, so that the pin can move from a first position to a second position, the biasing means biasing the pin in the first position.

Preferably the engagement slot includes a first and second section, the first section being adapted to move the securing means to the second position during engagement of the loading/unloading member with the track, or receiving member; and once the loading/unloading member is fully engaged with the receiving member, or track, the second section of the engagement slot allows the securing means to return to the first position thereby securing the loading/unloading member with the track, or receiving member.

Preferably the track, or receiving member, has a pair of securing means positioned adjacent to each other, the loading/unloading member having a corresponding pair of engagement slots.

Preferably the biasing means is a spring.

The loading/unloading member Is disengaged from the track, or receiving member, by moving the securing means from the first position to the second position.

The invention also provides for a tool to facilitate disengagement of the loading/unloading member from the track, or receiving member, the tool having a first member and a second member, the first member being adapted to support the loading/unloading member and the second member being adapted to move the securing means from the first position to the second position.

In an alternative embodiment the position of the securing means, and the engagement slots may be inverted in terms of their respective positions on the track, or receiving member, and the loading/unloading member.

BRIEF DESCRIPTION OF THE DRAWINGS

The present invention will now be described by way of example only and with reference to the figures in which.

DESCRIPTION OF THE PREFERRED EXAMPLE

The following description will be provided in the context of the particular embodiment illustrated in the figures. In these figures, the loading/unloading and track/receiving members are generally rectangular or square in section. However, this is not to be construed as a limiting feature and it is possible that other shapes could be used.

Figure 1:
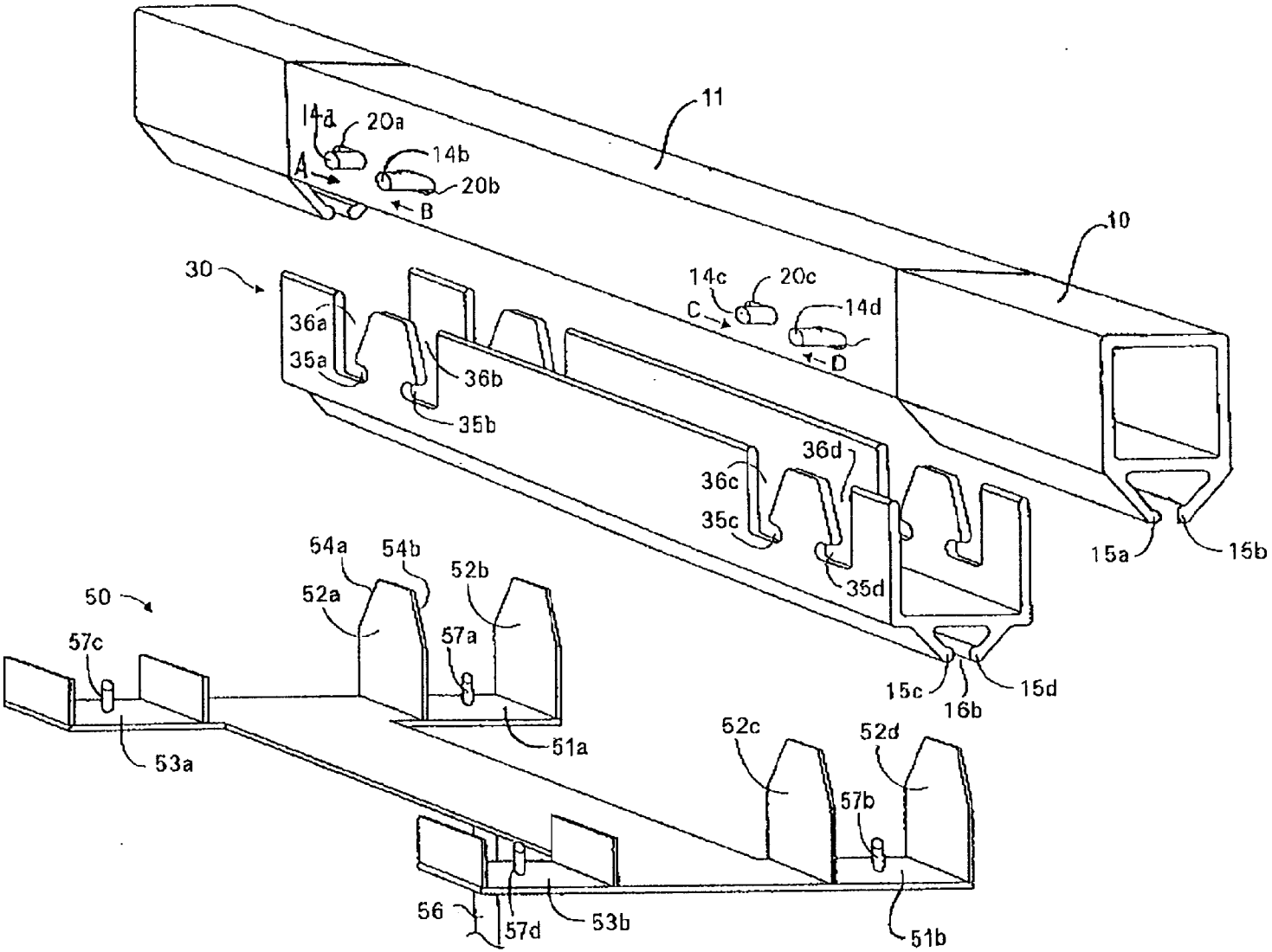
FIG. 1: illustrates a perspective view of an embodiment a us according to the invention.

FIG. 1 shows an embodiment of the current invention which includes a receiving member 11 located in a track 10; a loading/unloading member 30, and a tool 50. The track 10 is an elongate (usually extruded) member that has downwardly extending, and angled, lips 15*a* and 15*b* which form a channel 16*a* in known manner. The channel 16*a* is adapted so that it can accommodate the widened end of an attachment element (not shown) such as a hook or other attachment means which might be used to secure a curtain. The dimensions of the attachment elements (not shown) is such that the attachment elements slide along the channel 16*a* thus allowing the suspended curtain to be closed or open. Excluding the receiving member 11 and securing means (shown by 14*a*, 14*b*, 14*c*, 14*d*, 20*a*, 20*b*, 20*c* and 20*d*), the track 10 is generally in accordance with those which are known in the art.

The invention provides devices for loading and unloading a plurality of attachment elements from the track 10. According to the invention a section of track is replaced by a receiving member 11 which is adapted to receive a loading/unloading member, hereinafter called a cassette, 30. The cassette 30 has downwardly extending, and angled, lips 15*c* and 15*d* that form a channel 16*b*. A plurality of attachment elements can be engaged with the channel 16*b* of the loading/unloading cassette 30. When the loading/unloading cassette 30 is engaged with the receiving member 11 the channel 16*b* of the cassette 30 lines up with channel 16*a* of the track 10 and the plurality of receiving means can be moved from the cassette 30 on to the track 10. The cassette 30 can be disengaged from the receiving member 11 and the procedure repeated to load a further plurality of attachment elements on to the track 10.

The receiving member 11 has a securing means in the form of pins 14*a*, 14*b*, 14*c* and 14*d* extending laterally from either side of, and substantially horizontal to, the receiving member 11. The securing pins are located in longitudinally orientated slots 20*a*, 20*b*, 20*c* and 20*d* of the receiving member 11. The slots 20 are adapted to allow movement of pins 14 parallel to the longitudinal axis of receiving member 11.

In a preferred embodiment the receiving member 11 is inserted into a length of track to receive the loading/unloading cassette 30. However, it is appreciated that a normal section of track 10 could be modified to receive the loading/unloading cassette 30 by having its downwardly extending lips 15*a* and 15*b* removed and receiving pins 14*a*, 14*b*, 14*c*, 14*d* installed.

The securing pins 14 and slots 20 are positioned so that they correspond with engagement slots 36*a*, 36*b*, 36*c* and 36*d* in cassette 30. The embodiment in FIG. 1 shows a pair of pins 14 and slots 20 at either end of cassette 30. For smaller loading/unloading devices or lightweight applications, only two pins and slots might be used. For example pins 14*b* and 14*c* and slots 36*b* and 36*c* could be omitted leaving one pin/slot combination, say 14*a*/36*a* and 14*d*/36*d*, at either end of cassette 30 and receiving member 11.

The engagement slots 36 are substantially L-shaped with the slot terminating in locking sections 35 (35*a*, 35*b*, 35*c* and 35*d*). When the cassette 30 is engaged with receiving member 11, cassette 30 is held securely in place by engagement of pins 14 in corresponding locking sections 35 of engagement slots 36. In order to securely hold the pins 14 in locking sections 35 the pins 14 must be appropriately biased. Arrows A, B, C and D in FIG. 1 show the appropriate biasing direction for pins 14*a*, 14*b*, 14*c* and 14*d* respectively.

In the current embodiment pins 14 are biased by a spring 60. This is illustrated in FIG. 2. The spring 60 illustrated in FIG. 2 is representative for the purposes of description. In the actual embodiment of the invention the spring is not visible as it is enclosed within the receiving member 11, or track 10. The spring 60 is attached between a pair of pins (for example 14*a* and 14*b*) so as to appropriately bias the pins. The biasing spring 60 is similarly applied to pins 14*c* and 14*d*. It is noted however, that the spring 60 need not be attached between two pins 14, but that one end may be attached to any fixed point in order to provide appropriate biasing of any one pin (i.e., either 14*a*, 14*b*, 14*c* or 14*d*). A fixed attachment point for one end of spring 60 would be used where a small cassette 30 only has one pin/slot combination at each end. It is also understood that alternatives to a spring 60 for biasing the pins 14 may be used without departing from the scope of the invention.

Figure 2A:
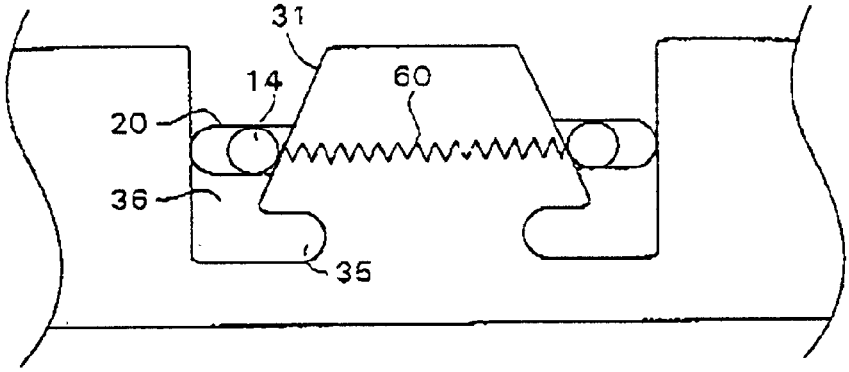
FIGS. 2*a* and 2*b*: illustrates operation of a first embodiment of a securing means and biasing means according to the invention.
Figure 2B:
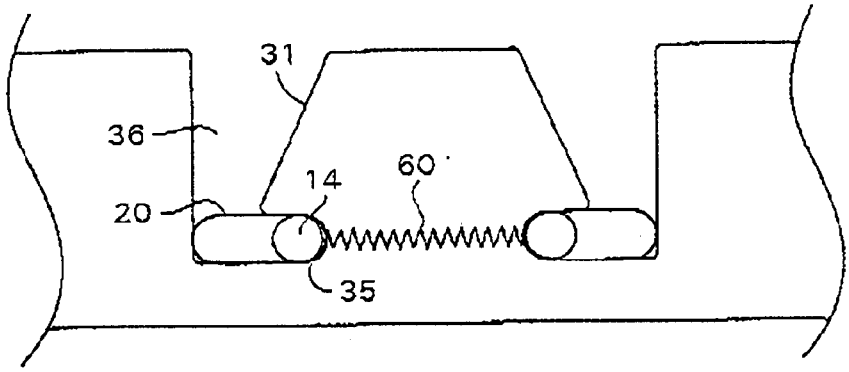

FIG. 2*a* shows a representation of the securing means 14 with cassette 30 partially engaged with receiving member 11. The following description illustrates the mechanics of the engagement process. Cassette 30 is raised Into position against receiving member 11 so that the angled sides 31 of the first section of slots 36 act against the biasing of pins 14. Slots 20 allow pins 14 to move to their second position as the cassette 30 is raised into position. Once the cassette 30 is fully in position (as shown in FIG. 2*b*) biasing spring 60 causes pins 14 to move back to their first position and engage in locking section 35 of slots 36. The cassette 30 is securely held in position on the receiving member 11. Channel 16*b* lines-up with channel 16*a* allowing attachment elements to be moved between the cassette 30 and track 10.

Figure 3:
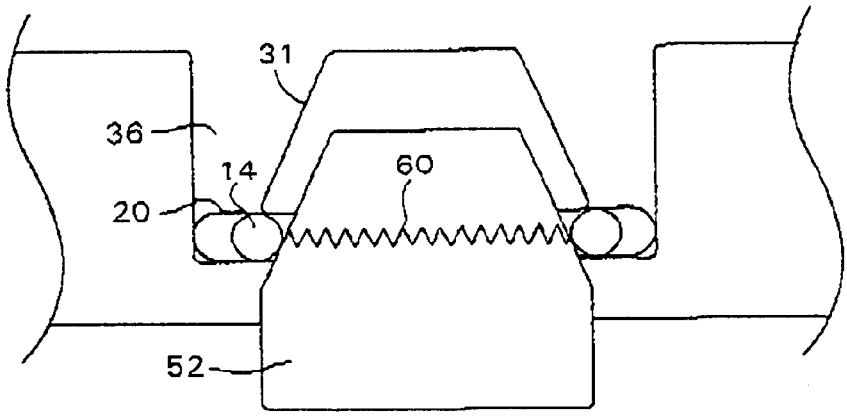
FIG. 3: illustrates releasing of the securing means.

In order to remove cassette 30 from receiving member 11 the invention also provides a tool 50. The tool 50 may take different forms, with the important feature being members 52*a*, 52*b*, 52*c* and 52*d* which have angled edges 54*a* and 54*b* (numbered on member 52*a* only) for releasing the securing pins 14. The tool 50 may take a variety of shapes and configurations and the embodiment illustrated in FIG. 1 is only a particular example of that which might be used. FIG. 3 shows the importance of members 52 in releasing the cassette 30 from the receiving member 11. Edges 54 of member 52 are brought to bear against pins 14. As the tool 50 is raised into position edges 54 of member 52 cause pins 14 to move to their second position in slots 20 thereby disengaging from locking section 35. Once member 52 has moved pins 14 fully clear of locking section 35 the cassette 30 can be removed from the receiving member 11. Pins 14 withdraw from slot 36.

It will be appreciated from the aforegoing description that cassette 30 can be engaged with, or disengaged from, receiving member 11 with a single movement from an operator.

Figure 4A:
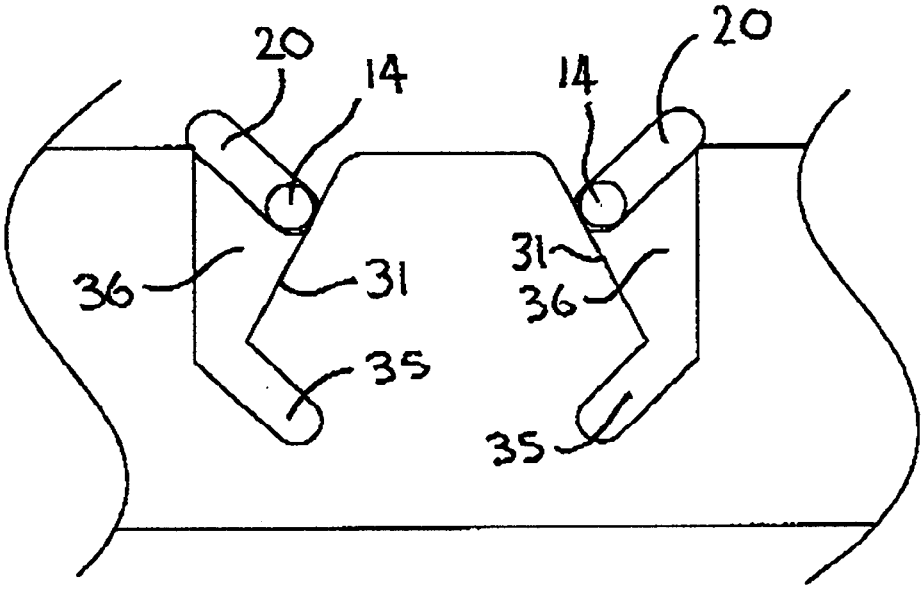
FIGS. 4*a* and 4*b*: illustrates operation of an alternative embodiment of a securing means and biasing means.
Figure 4B:
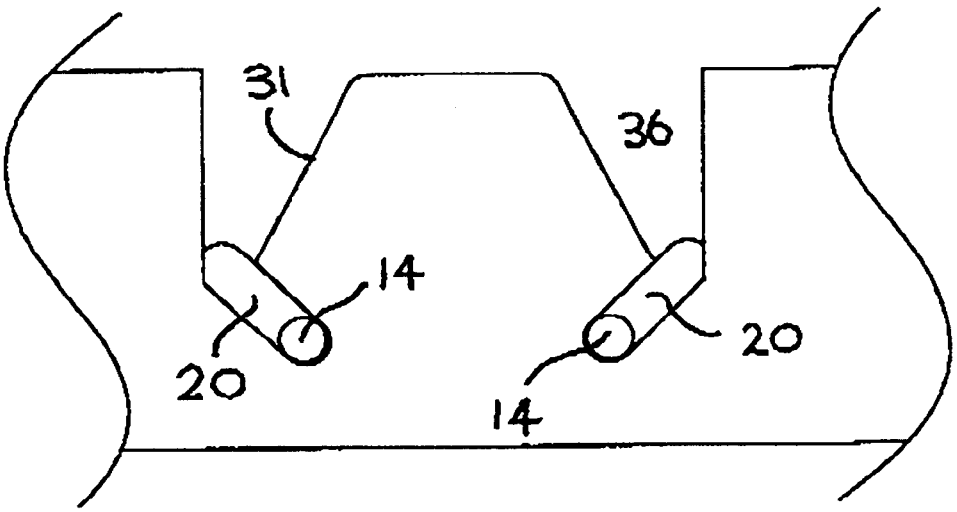

In an alternative embodiment of the invention, illustrated in FIGS. 4*a* and 4*b*, it is envisaged that the biasing means may be gravity. In this embodiment, slots 20 are angled so that pins 14 fall into the first position under the influence of gravity. Locking section 35 of slots 36 has a corresponding angle. As cassette 30 is lifted into position edges 31 move pins 14 up and along slots 20 to their second position. When cassette 30 is fully positioned pins 14 will fall back into their first position. The force applied to pins 14 by engaged cassette 30 is lateral to slots 20 and the cassette is securely held in place. A suitable angle for slots 20 is 45 degrees.

The embodiment of tool 50 shown in FIG. 1 has surfaces 51*a* and 51*b* which support the cassette 30 once pins 14 are disengaged from locking position 35. To avoid the cassette 30 slipping, longitudinally, off tool 50 locating studs 57*a* and 67*b*, protruding from surfaces 51*a* and 51*b*, engage within locating holes (not shown) in the cassette 30.

A particular advantage of the current embodiment is that members 52 can be mounted on a pole 56 allowing cassette 30 to be disengaged from receiving means 11 without the aid of a ladder or other elevation means. A single movement is all that is required. This is particularly advantageous in today's health and safety environment, and also allows faster removal of attachment elements thereby increasing productivity. The particular tool 50 shown in FIG. 1 also has areas 53*a* and 53*b* which allow the cassette 30 to be lifted for engagement purposes.

Locating studs 57*c* and 57*d* are provided on surfaces 53*a* and 53*b* to avoid the cassette 30 sliding or moving on the tool when it is being engaged.

While in the particular embodiment shown in FIG. 1 the cassette 30 fits externally around receiving member 11, it is understood that cassette 30 may also fit within receiving member 11 if it were an inverted channel or that the arrangement of pins and slots may be reversed so that the slots are in receiving member 11 and pins 14 are fitted to cassette 30. Such modifications are considered well within the capability of a person skilled in the art and do not depart from the scope of the invention.

It has been found that the present novel loading/unloading device provides a significant advantage over the prior art in that there is no gap required in channel 16*a* of track 10. Also a single movement is all that is required to engage or disengage the cassette. The application of a tool for fitting and removing the cassette from the receiving member also allows the track to be located in elevated locations without the need for a ladder or other elevating means. This is particularly advantageous where a large number of attachment elements are used and need to be changed on a regular basis such as for hospital partitions in a hospital environment. Once the cassette has been locked in place the user can simply draw the curtain on to the track 10.

The present invention provides a significant utility and that it is extremely fast to use, secure and safe in terms of loading the cassette. The construction is relatively simple and, in terms of simplicity of construction is highly reliable. The cassette simply snap locks into place with a single movement, either by hand or the use of a tool, and disengaged either by hand or with the use of the tool.

Wherein the aforegoing description reference has been made to elements or integers having known equivalents, then such equivalents are included as though individually setforth.

Although the invention has been described by way of example and with reference to particular embodiments, it is understood that modifications and/or improvements can be made without departing from the scope of the attached claims.

What is claimed is:

1. A device for loading or unloading a plurality of attachment elements to/from a channel of a track, the track having first and second longitudinal spaced track sections provided respectively with first and second spaced apart channel sections adapted to receive the attachment elements, said device comprising:

a receiving member adapted to extend between the first and second track sections; the receiving member having at least one securing means for movement between a first position and a second position, a biasing means for biasing the securing means towards the first position; and a loading/unloading member with a channel adapted to receive a plurality of the attachment elements and dimensioned to extend between the first and second channel sections, the loading/unloading member having engagement means for removably engaging the securing means of the receiving member by a single operator movement, and when engaged the attachment elements can be moved between the first and second channel sections and the loading/unloading member channel.

2. A device as claimed in claim 1 wherein the securing means is an elongated pin extending, in a substantially horizontal orientation, laterally through the receiving a member with the ends of the pin protruding from either side of the receiving member; the pin being located in, and free to move within, a slot orientated longitudinally with the receiving member so that the pin can move from a first position to a second position, the biasing means biasing the pin in the first position.

3. A device as claimed in claim 1 wherein the engagement means includes a first and second section, the first section being adapted to move the securing means to the second position during engagement of the loading/unloading member with the receiving member; and once the loading/unloading member is fully engaged with the receiving member the second section of the engagement means allows the securing means to return to the first position thereby securing the loading/unloading member with the receiving member.

4. A device as claimed in claim 1 wherein the receiving member has a pair of securing means positioned adjacent to each other, the loading/unloading member having a corresponding pair of engagement means.

5. A device as claimed in claim 1 wherein the biasing means is a spring.

6. A device as claimed in claim 1 wherein the loading/unloading member is disengaged from the receiving member by moving the securing means from the first position to the second position.

7. An assembly comprising the device as claimed in claim 1, and a tool to facilitate disengagement of the loading/unloading member from the receiving member, the tool having a first member and a second member, the first member being adapted to support the loading/unloading member and the second member being adapted to move the securing means from the first position to the second position.

8. A method of loading or unloading a plurality of attachment elements to a channel of track, the method including the steps of:

modifying the track to provide first and second longitudinally spaced track sections provided respectively with first and second longitudinally spaced channel sections adapted to receive a plurality of attachment elements;

mounting a receiving member between the first and second track sections, the receiving member having at least one securing means for movement between a first position and a second position, a biasing means for biasing the securing means towards the first position;

providing a loading/unloading member having a channel adapted to receive a plurality of attachment elements and dimensioned to extend between the first and second channel sections of the modified track;

engaging, or disengaging the loading/unloading member to/from the modified track via the securing means; and moving a plurality of attachment elements between the track and the loading/unloading member or vice versa to load or unload the attachment elements.

9. A method as claimed in claim 8 wherein the securing means is an elongated pin extending, in a substantially horizontal orientation, laterally through the modified track, with the ends of the pin protruding from either side of the track; the pin being located in, and free to move within, a slot orientated longitudinally with the track so that the pin can move from a first position to a second position, the biasing means biasing the pin in the first position.

10. A method as claimed in claim 8 wherein the engagement slot includes a first and second section, the first section being adapted to move the securing means to the second position during engagement of the loading/unloading member with the modified track, and once the loading/unloading member is fully engaged with the track the second section of the engagement slot allows the securing means to return to the first position thereby securing the loading/unloading member with the track or receiving member.

11. A method as claimed in claim 8 wherein the modified track has a pair of securing means positioned adjacent to each other, the loading/unloading member having a corresponding pair of engagement slots.

12. A method as claimed in claim 8 wherein the biasing means is a spring.

13. A method as claimed in claim 8 wherein the loading/unloading member is disengaged from the modified track by moving the securing means from the first position to the second position.

* * * * *